US006741830B2

(12) United States Patent
Kinoshita et al.

(10) Patent No.: US 6,741,830 B2
(45) Date of Patent: May 25, 2004

(54) IMAGE FORMING APPARATUS

(75) Inventors: Yasushi Kinoshita, Toride (JP); Kazutaka Sato, Kashiwa (JP); Shigeru Obata, Ishioka (JP); Akitomo Kuwabara, Hitachinaka (JP); Tetsuya Ooba, Hitachinaka (JP)

(73) Assignees: Hitachi, Ltd., Tokyo (JP); Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/229,056

(22) Filed: Aug. 28, 2002

(65) Prior Publication Data

US 2003/0053833 A1 Mar. 20, 2003

(30) Foreign Application Priority Data

Sep. 18, 2001 (JP) ..... 2001-282568

(51) Int. Cl.[7] ..... G03G 15/00

(52) U.S. Cl. ..... 399/384; 101/484; 101/485; 399/16; 399/395

(58) Field of Search ..... 399/384, 16, 38, 399/390, 394–396, 165; 198/804, 810.03, 810.04; 101/484, 485, 486; 242/410

(56) References Cited

U.S. PATENT DOCUMENTS 5,774,777 A * 6/1998 Ohtsuka et al. ..... 399/384

2002/0011170 A1 * 1/2002 Kuwabara et al. ..... 101/484

FOREIGN PATENT DOCUMENTS

| | | | |
|---|---|---|---|
| JP | 03-183580 | * | 8/1991 |
| JP | 08-012146 | * | 1/1996 |
| JP | 2002-046912 | * | 2/2002 |

* cited by examiner

*Primary Examiner*—Sophia S. Chen
(74) *Attorney, Agent, or Firm*—Antonelli, Terry, Stout & Kraus, LLP

(57) ABSTRACT

When initially routing a continuous web along a path, the web walks across the width of the path, and uneven tension occurs causing the web to break in some cases when printing tension is applied thereto. Further, uneven web tension is produced on the right and left of the web by excessive walk control resulting from an excessive deviation of the web from the target position of a walk controller, with the result that the web is crumpled and broken. These problems are solved by maintaining a web tension that is lower than the printing tension until the web position converges on the target position of the walk controller after loading of the web, thereby reducing the amount of correction by the walk controller and the amount of web lost in the preparatory phase before printing, with the result that excellent image quality free from crumple or breakdown is ensured.

8 Claims, 4 Drawing Sheets

IMAGE FORMING APPARATUS

BACKGROUND OF THE INVENTION

1. Field of the Invention

The present invention relates to an image forming apparatus wherein the web of a web press or the like is fed with tension applied thereto.

2. Prior Art

The following describes the general image forming apparatus with reference to FIG. 2.

In FIG. 2, the image forming apparatus 1 mainly comprises an infeed unit 2, a tension controller 3, a walk controller 4, an image forming unit 5, a fixing apparatus 6, an outfeed unit and a feed roller 8 (not illustrated in FIG. 1). Numeral 9 denotes a web where continuous paper such as rolled paper supplied in the form wound in a roll or box paper supplied in a form folded in a certain length is used. This web 9 forms a feed path "a" running through the above stated apparatuses 2, 3, 4, 5, 6, 7 and 8 in that order.

The web 9 is straightened by a pre-processor (not illustrated) and is fed to the infeed unit 2.

To ensure high-precision feed on the image forming apparatus 1, tension is applied to the web in the area from the infeed unit 2 to the outfeed unit 7, and the web is fed under this tension. This area is provided with the tension controller 3 for ensuring stable tension and the walk controller 4 for correcting walking of the web 9 across the width.

The web 9 having its feed accuracy ensured is dried and fixed by the fixing apparatus 6 after an ink image and toner image have been transferred thereon, by the image forming unit 5. Then the web 9 is ejected out of the engine as a print output.

The image forming apparatus 1 using continuous paper requires preparatory work wherein the web 9 is routed through the feed route "a" at the time of installation or before printing is started because of processing of the broken web 9 or others. The web can be routed by a manual method or by using a paper feed roller or a traction member.

FIG. 3 is a diagram representing an automatic paper routing technique by a paper feed roller 83, as is also shown in FIG. 2.

In FIG. 3, paper feed rollers 83 movable, as shown by a dotted line, are provided at various positions on the feed path "a", opposite to each feed rollers 8 forming the feed path "a" shown in FIG. 2. These paper feed rollers 83 are configured to contact the feed rollers 8 only when paper is routed, and to feed paper along the feed path "a". The web 9 is gripped and fed successively by paper feed rollers 83, and is routed through the fed path "a".

FIG. 4 is a diagram representing an automatic paper routing technique by a traction member 84.

In FIG. 4, traction members 84 such as wire ropes are routed on both sides along the feed path "a" of the web 9. The leading edge of the web 9 is fixed through the traction members 84 on the right and left and the traction cord, and the web 9 is routed through the feed path "a" as it is pulled by traction members 84.

A great variety of traction based paper routing methods have been proposed.

The major point of these paper routing technique is to route the web 9 through the feed path "a", and only paper end guide 85 are provided for positioning of the web 9 across the width, without further effective measures being taken. These paper end guides 85 are arranged at various places on the feed path "a" where the web 9 is routed, and the web 9 is fed under the control of these paper end guides 85.

Paper end guides 85 are arranged so that their distance will be greater than the width of the web 9. This is to ensure that they will not interrupt paper feed. So the web 9 is fed while walking to the right and left between feed guides 85.

As described above, the major point of the above stated paper routing technique is to route the web 9 through the feed path "a", and only paper end guide 85 are provided for positioning of the web 9 across the width. This technique fails to ensure satisfactory initial loading position accuracy for the web across the width, with the result that the web may be loaded while walking at various parts on the feed path.

When the web is loaded while walking as described above, uneven tension occurs between feed rollers if printing tension is applied to the web, and the web is broken in some cases.

Should the web remain unbroken, the bent portion is caught by various rollers if web feed is continued. As a result, the web was crumpled and paper jamming or a big walk actually occurred in some cases.

Further, if walk control is performed, the difference between initial web loading position and the target position (the position where the width direction of the web is corrected) of the walk controller is much greater than the amount of walking appearing in the normal feed. This may result in excessive working of the walk control, and uneven web tension in the lateral direction. As a result, paper was actually crumpled or broken in some cases.

SUMMARY OF THE INVENTION

An object of the present invention is to provide an image forming apparatus characterized in that the web position across the width is determined to an high accuracy before printing starts, whereby uniform tension on the right and left is ensured, and the web is prevented from being crumpled or broken.

The above stated object can be attained by the present invention by an image forming apparatus which comprises two feed means for feeding a web, tension control means arranged on between said two feed means and for giving a predetermined tension to said web, walk control means for correcting a position of a width direction of said web, an image forming means for forming an image on said web, fixing means for drying and fixing said image formed on said web, and feed rollers for constituting a feed passage in which said feed passage is arranged to pass through said web on said respective above means; the image forming apparatus, wherein a low tension feed process is provided, said low tension feed process feeds said web, before a printing, until to syusoku an initial mounting position of said width direction of said web to a target position of said walk control means, a tension of said web is restrained lower than a tension during the printing, and carries out a walk correction according to said walk control means.

The above stated object can be attained by the present invention by an image forming apparatus, wherein a web feed speed of said low tension fed process is kept lower than a feed speed during the printing.

The above object can be attained by the present invention providing an image forming apparatus comprising: feed means arranged on the upstream and downstream sides of a web feed path, tension control means arranged between these feed means in order to give a specified tension to the above stated web, walk control means for correcting the position of the above stated web across the width, image forming means for forming an image on the above stated web, and fixing means for drying and fixing the image formed on the above stated web through the above stated image forming means; the above stated image forming apparatus characterized by comprising a low tension feed process further comprising; a step for keeping the tension of the above stated web lower than that at the time of image formation until the initial loading position of the above stated web across the width reaches the target position of the above stated walk control means, and a step for feeding the above stated web while correcting walk with walk control means.

The above object can also be attained by the present invention providing an image forming apparatus wherein the above stated low tension feed process is characterized in that said web feed speed is lower than the feed speed at the time of image formation.

The above object can also be attained by the present invention providing an image forming apparatus wherein the above stated low tension feed process is characterized in that the difference in the distance between initial web loading position and target position of said walk control means is increased.

The above object can also be attained by the present invention providing an image forming apparatus characterized in that the above stated walk control means comprises a walk sensor.

The above object can also be attained by the present invention providing an image forming apparatus characterized in that the time for terminating said low tension feed process is determined by processing the reading of the above stated walk sensor.

The above object can also be attained by the present invention providing an image forming apparatus characterized in that the web feed speed of the above stated low tension feed process is lower than that at the time of image formation.

DETAILED DESCRIPTION OF THE INVENTION

Figure 1:
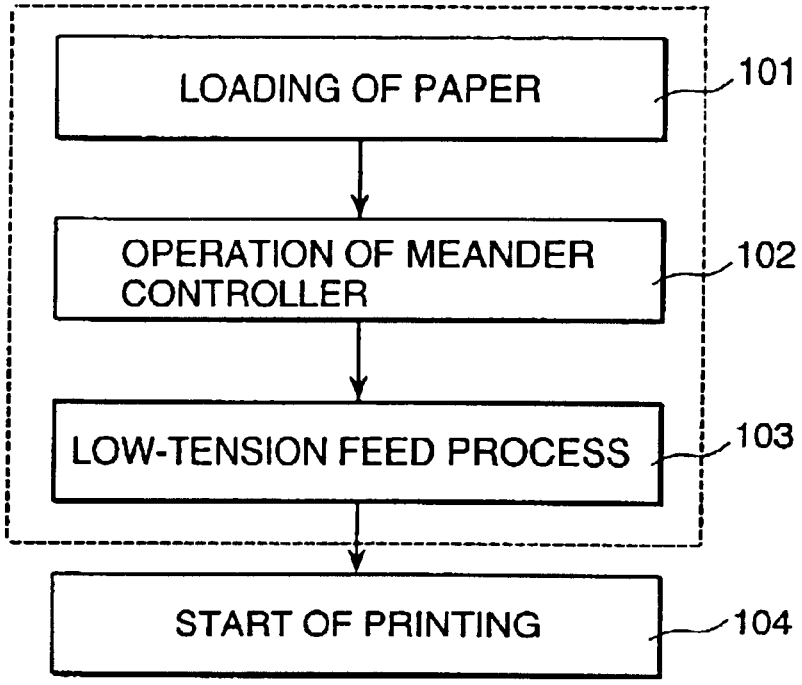
FIG. 1 is a diagram representing the preliminary process of an image forming apparatus as an embodiment of the present invention.

FIG. 1 shows the preliminary process of an image forming apparatus as an embodiment of the present invention. FIG. 1 is a flow chart representing the preliminary process.

In FIG. 1, paper is loaded in Step 101. The walk controller for controlling the walk of loaded paper is operated in Step 102. Step 103 is a low tension feed process. After termination of this process, printing is started in Step 104.

Figure 2:
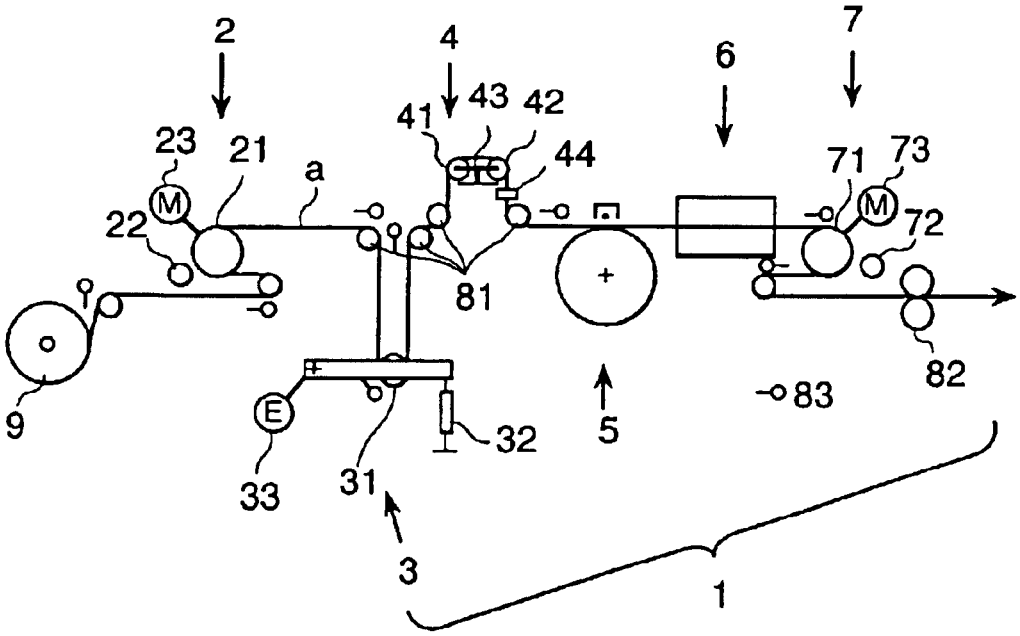
FIG. 2 is a cross sectional view representing the configuration of the image forming apparatus.

The following describes a general image forming apparatus as an embodiment according to the present invention with reference to FIG. 2. FIG. 2 is a cross sectional view representing the configuration of the image forming apparatus.

In FIG. 2, the image forming apparatus 1 mainly comprises an infeed unit 2, a tension controller 3, a walk controller 4, an image forming unit 5, a fixing apparatus 6, an outfeed unit and a feed roller 8 (not illustrated in FIG. 1). A web 9 forms a feed path "a" running through the above stated said apparatuses in that order. The web 9 is a continuous paper such as rolled paper supplied in the form wound in a roll or box paper supplied in a form folded in a certain length.

The web 9 is straightened by a pre-processor (not illustrated) and is fed to the infeed unit 2.

The infeed unit 2 comprises an infeed roller 21 and back roller 22. The infeed roller 21 is equipped with a drive motor 23. The web 9 winds around the infeed roller 21 to get a required contact with, and is pressed out by the back roller 22, whereby the drive force of the drive motor 23 is effectively and smoothly transmitted.

The tension controller 3 comprises a dancer roller 31, loading means 32 and position detector 33. The dancer roller 31 is suspended from the web 9, and can be moved freely in the vertical direction. The dancer roller 31 has a function of applying tension to the web 9 under its own weight or by loading means 32 such as a weight, spring force and cylindrical pressure. If an abrupt change in tension occurs, the dancer roller 31 absorbs it by changing its own position, thereby ensuring a constant tension at all times.

A control system is configured in such a way that the position of the dancer roller 31 is detected by the position detector 33, and the speed of the infeed roller 21 is fine-adjusted in conformity to the amount of traveling, thereby ensuring return to a predetermined position.

The walk controller 4 comprises two correction rollers 41 and 42 arranged in parallel, a turn table 43 for securing their roller shafts and rotating together with correction rollers 41 and 42, and a walk sensor 44. The walk of the web 9 is detected by the walk sensor 44, and the turn table rotates in response to the amount of walking. Two correction rollers 41 and 42 are tilted in the direction of feed by the rotation of the turn table, whereby the traveling position of the web 9 is corrected.

The image forming unit 5 forms an ink image by a plate cylinder, a toner image by electrophotographic printing and an ink jet image. This image forming unit 5 can be designed in a tandem configuration in such a way that multiple images are overlaid to output a colored image, or an image is formed on both sides of the web 9.

The fixing apparatus 6 is installed to dry and fix an image on the web.

The outfeed unit 7 is designed in the same configuration as the infeed unit 2, and comprises an outfeed roller 71, a back roller 72 and a drive motor 73.

The following describes how to route the web in an embodiment of the present invention:

Routing of the web 9 is carried out when the image forming apparatus 1 is installed or a broken web is processed. It consists of a step of setting the web 9 on the feed path "a". The web can be routed by a manual method or by using a paper feed roller or a traction member.

When the number of rollers is small, the web can be routed manually. If there are many rollers in a large-scale image forming apparatus 1, it is necessary to automate the web routing process using a paper feed roller 83 and traction member 84 to be described later. Numeral 81 denotes an idler, and 82 shows a puller.

Figure 3:
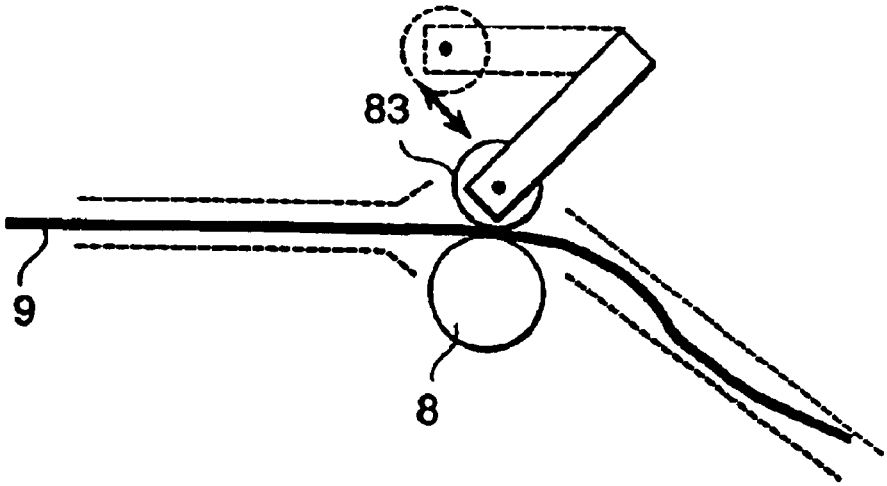
FIG. 3 (PRIOR ART)
FIG. 3 is a diagram representing a conventional method for automatic paper feeding by a paper feed roller.

FIG. 3 is a diagram representing the details of automatic paper feeding by a paper feed roller 83.

In the automatic paper routing by paper feed roller 83 of FIG. 3, the paper feed rollers 83 movable with respect to the web 9, as shown by a dotted line, are provided opposite to each feed rollers 8 forming the feed path "a" at various positions on the feed path "a".

These paper feed rollers 83 are configured to contact the feed rollers 8 only when paper is routed, and to feed out paper along the feed path "a" by gripping the web 9. The web 9 is routed through the fed path "a" as the paper feed rollers 83 provided at various positions on the fed path "a" are driven successively.

This paper routing step requires use of a great numbers of paper feed rollers 83, hence substantial costs and space.

Figure 4:
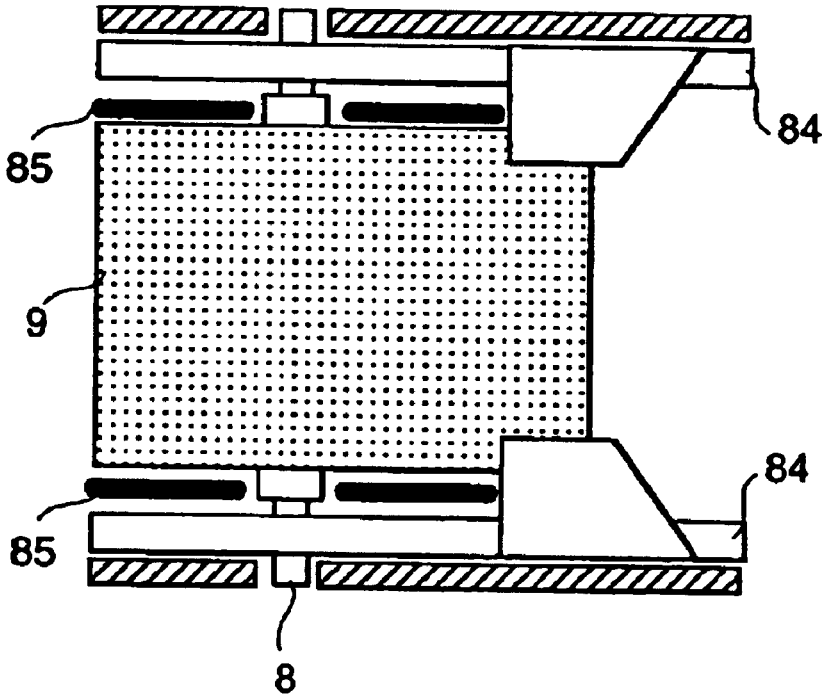
FIG. 4 (PRIOR ART)
FIG. 4 is a diagram representing an automatic paper routing technique by a traction member.

FIG. 4 is a diagram representing an automatic paper routing technique by traction member 84.

In FIG. 4, the reaction member 84 such as wire rope is routed on both sides along the feed path "a" of the web 9. In automatic paper routing by traction member 84, the tip of the web 9 is connected to the traction rope arranged along the feed path "a" is fed by traction force, whereby paper is routed. Various techniques for traction type paper routing have been proposed.

In paper routing technique given in FIG. 4, the major point is to route the web 9 through the feed path "a". For positioning of the web 9 across the width, only paper end guides 85 are provided—no further measures have been taken. Paper end guides 85 are provided at various positions on the feed path "a" where web 9 is routed.

The web 9 is fed along the feed path "a" under the control of the paper end guides 85. The distance between the paper end guides 85 on the right and left set to be greater than the width of the web 9 in such a way that they will not interrupt paper feed.

Here if the distance between the paper end guides 85 is reduced to a level very closed to the thickness of the web 9 in an attempt to ensure a high loading position accuracy of the web 9, then the load will be increased, and, furthermore, the end of the web 9 will run onto the paper end guides 85, resulting in a damage of the web 9 in some cases. To avoid this, the distance between the paper end guides 85 must be much greater than the width of the web 9.

Further, in the image forming apparatus feeding a great variety of webs 9, the width varies according to the type of the web 9. To solve this problem, a mechanism of changing the position of the paper end guides 85 is provided in some cases. In these cases, however, it is difficult to achieve high precision positioning of the paper end guides 85, and the web 9 loading position accuracy b is limited to the level of millimeters.

As described above, the automatic paper routing technique given in FIG. 4 fails to provide high web-9 loading position accuracy, so the web 9*s* walks at various positions on the feed route "a". If printing tension is applied under this condition, uneven tension is applied among different rollers, and the web may be broken.

Should the web remain unbroken, the bent portion is caught by rollers if web feed is continued, with the result that the web may be crumpled and paper jamming or a big walk may occur.

Furthermore, when walk control is applied, the difference between the initial web-9 loading position "b" and target position "c" of the walk controller is much greater than the amount of walk at the time of normal feed. This may lead to excessive walk control.

The walk controller 4 corrects the position of the web 9 across the width by rotating the turn table 43 and tilting the correction rollers 41 and 42 with respect to the feed route "a". The web is subjected to torsion before and after the walk controller 4, resulting in uneven tension on the right and left. This will cause the web 9 to be crumpled or broken.

The present invention provides a low tension feed process that correct the initial web-9 loading position "b" by feeding the web 9 at a tension sufficiently lower than printing tension before start of printing.

Figure 5:
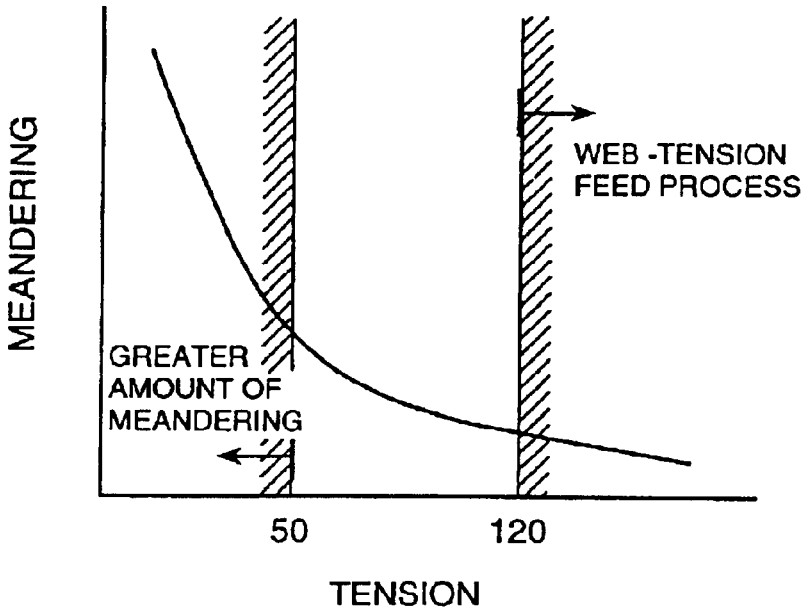
FIG. 5 is a graph representing the relationship between the web tension and walking.

FIG. 5 is a graph representing the relationship between the web tension and walking.

In FIG. 5, it is necessary to meet the requirements of both the feed accuracy in the feed direction and accuracy in the walking direction in order to achieve high-precision printing.

According to the experiment, feed accuracy can be improved by ensuring an appropriate tension of the web 9.

For example, in the box paper having a width of 380 mm and a ream weight of 55 kg, satisfactory feed accuracy can be achieved at a tension of 50N and over up to and including 120N. At a low tension less than 50N, the feed accuracy in the feed direction cannot be achieved since winding on the feed roller is insufficient.

Further, increased amounts of walk and crumple are observed on each part of the feed path "a". If the tension is more than 120N, both feed accuracy and walking are satisfactory, and high-precision feed is achieved, but the fracture strength of the web 9 is exceeded by a slight tension on the right and left, with the result that the web will be broken from one side.

Box paper has a perforated tear-off line formed on the folded position, and is very likely to be destroyed. The maximum value of tension is limited by the fracture strength of the web 9. So if the feed accuracy is not sufficient, use of a rolled paper without perforated tear-off line is preferred.

In the printing mode where high feed accuracy is required, it is necessary to increase the tension to the level close to the fracture strength of web 9. The purpose of the low tension feed process is to converge the initial web-9 loading position "b" on the target position "c" of the walk controller. So the tension should be set at a lower value.

In the above stated tension range, for example, the tension of the low tension feed process should be set to about 60N when the printing tension is set to 100N. Since the purpose of the low tension feed process can be achieved by at a tension sufficiently lower than that of the printing tension, uneven tension leading to fracture does not occur even if the initial web-9 loading position "b" is walking.

To achieve a low tension, it will be possible to use the technique of reducing the tension settings at the time of feed or utilizing the feed load. In this case, the infeed roller 21 releases the back roller 22 in such a way that pressure is not applied. The web 9 is fed by the outfeed roller 71 or is fed by a puller 82 that is provided on the further downstream side.

It should be noted that walking might be caused by distribution of the pressure of the back roller 72 when the outfeed roller 71 is used for feeding. When a puller is provided on the downstream side, uniform feed force is applied over the entire surface of the web 9. In this case, the outfeed roller 71 releases the back roller 72 so that pressure is not applied, similarly to the case of the infeed roller 21. Further, the puller 82 cannot provide a big feed force.

Accordingly, it is possible to reduce the feed load by idling the feed rollers 21 and 71 in the feed direction or by installing a mechanism for driving a roller of greater loads, depending on the degree of feed load.

Figure 6:
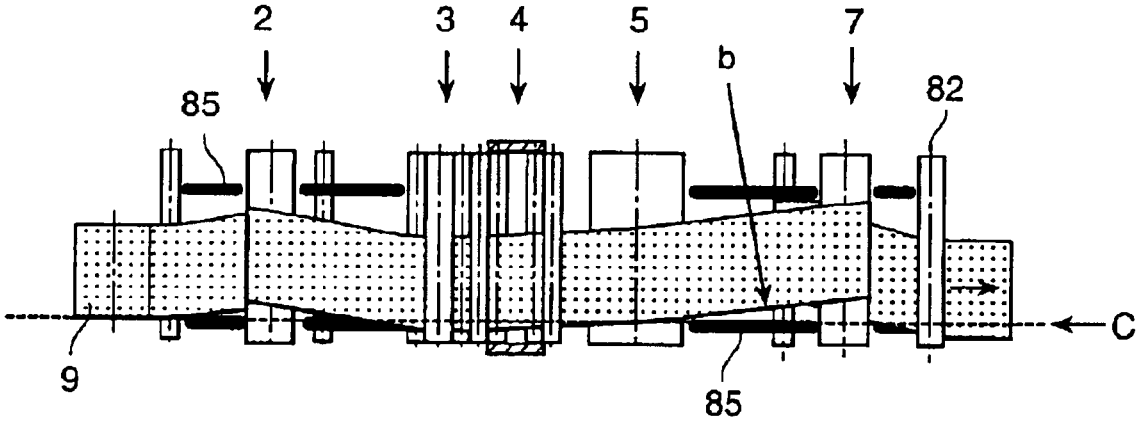
FIG. 6 is a top view of the feed path of the image forming apparatus according to the present invention.
Figure 7:
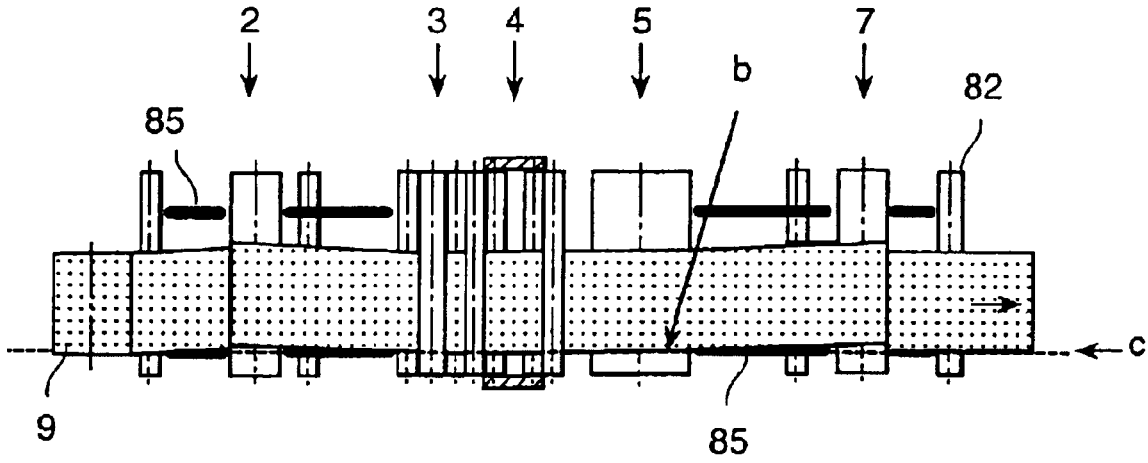
FIG. 7 is a top view of the feed path upon termination of low tension process.

The following describes conformability of the web 9 by the low tension feed process with reference to FIGS. 6 and 7.

FIG. 6 is a top view of the feed path immediately after paper is fed.

FIG. 7 is a top view of the feed path upon termination of low tension process. In FIGS. 6 and 7, walking occurs over the width of the paper end guide 85 among rollers immediately after web 9 is fed.

So depending on the positions, the initial web-9 loading position "b" may be far removed from the target position "c" of the walk controller 4, as shown in FIG. 6. However, the low tension feed process allows the initial web-9 loading position "b" to be converged on the target position "c" of the walk controller 4. In this case, a small amount of walking remains.

This is caused by a slight deviation in parallelism resulting from the installation accuracy of the feed roller 8. This amount of walking results from an ideal path without undue force applied to the web 9. If this is ignored and the web is loaded and fed in a straight line by the paper end guides 85 and the like, then undue force will be applied to the end of the web 9, with the result that web 9 may be damaged in some cases.

When the web 9 is fed at a low tension, web-9 loading position "b" cannot be converged on the target position "c" of the walk controller 4. Not only that, the web cannot be converted on the optimum path.

Figure 8:
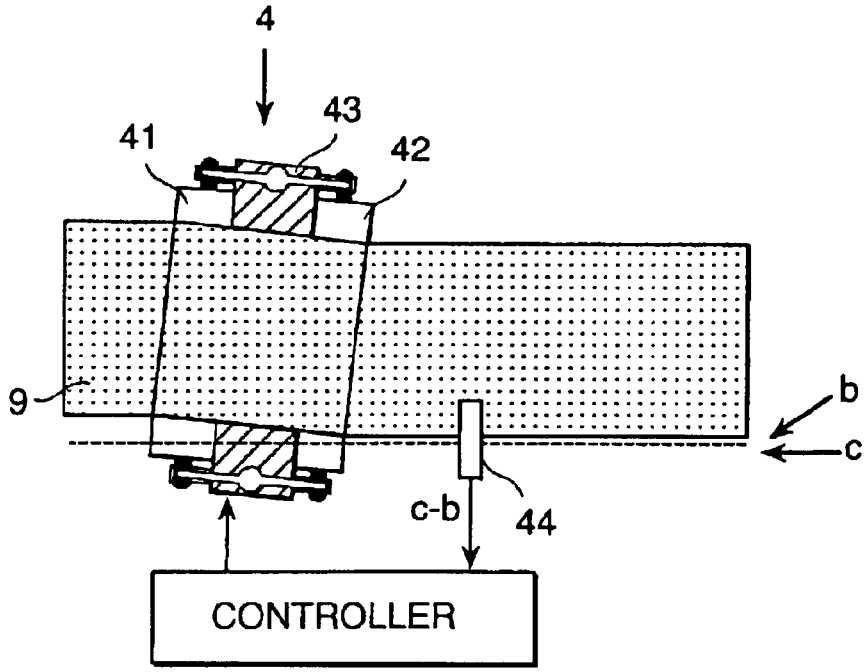
FIG. 8 is an explanatory diagram representing the initial recording medium loading position "and target position of a walk controller.

The following describes the role of the walk controller 4 in the low tension feed process:

FIG. 8 is an explanatory diagram representing the initial recording medium loading position "b" and target position "c" of the walk controller 4.

The low tension feed process provides the following advantages by using the walk controller 4.

The first advantage is that, when there is a big difference between the initial web-9 loading position "b" and target position "c" of the walk controller 4, the web is not broken even if the walk controller 4 works excessively. This is because the tension is the web 9 is low.

The second advantage is that convergence on the target position "c" of the walk controller 4 is achieved while the web 9 located at the initial loading position "b" is fed, with the result that there is a decrease in the amount of walk control in the walk controller 4 when tension is applied. Thus, uneven tension of the web 9 on the right and left is reduced, and crumpling of paper does not occur.

The third advantage is that the speed of convergence on the target position "c" is increased by an effective use of the walk controller 4, whereby paper loss is reduced.

The period of low tension process of the recording paper shown in FIG. 8 terminates as the web 9. The time of termination can be determined by processing the reading of the walk sensor 44. For example, presence for five seconds within the range of ±50 $\mu$m may be used as a criterion to determine the time of termination.

The web 9 fed by the time when termination is determined will entirely be reduced to lost paper, so the criterion may be set at the level looser than that of the specification requirements. The amount of paper lost in acceleration and deceleration can be reduced by setting the feed speed in the low tension feed process at a value lower than printing speed.

For example, at the acceleration/deceleration rate of 400 $mm^2$/sec., the amount of the web 9 required to increase the feed speed to 400 mm/sec. is 200 mm. By contrast, the amount of the web 9 required to increase the feed speed to a reduced value of 200 mm/sec. is 50 mm. This means a reduction of paper loss to one fourth.

As described above, the image forming apparatus of the present invention where continuous recording paper of a web press or the like is fed is configured in such a way that the low tension feed process is included in the preliminary process of routing the web through the feed path before printing.

Not only that, the low tension feed process is provided with a process wherein, after the web has been loaded, the web tension is kept lower than that in the printing mode until the initial web loading position across the width converges on the target position "c" of the walk controller, and the web is fed while walking is corrected by the walk controller.

The present invention provides an image forming apparatus wherein the high-precision web position across the width is determined before printing is started, and the tension of the web is kept uniform on the right and left, thereby preventing the web from being crumpled or broken.

What is claimed is:

1. In an image forming apparatus comprising two feed means for feeding a web along a feed passage, tension control means arranged on said feed passage between said two feed means for giving a predetermined tension to said web, walk control means arranged on said feed passage for correcting the position of said web a width direction of said feed passage, image forming means arranged on said feed passage for forming an image on said web, fixing means arranged on said feed passage for drying and fixing said image formed on said web, and feed rollers for constituting said feed passage;

the image forming apparatus, wherein a low tension feed process is provided so as to feed said web, before printing, until an initial mounting position of said web in the width direction of said feed passage converges to a target position of said walk control means, in which low tension feed process the tension of said web is restrained to a level lower than the tension which is provided during printing and a walk correction is carried out according to said walk control means.

2. An image forming apparatus according to claim 1, wherein the web feed speed of said low tension feed process is kept lower than the feed speed used during printing.

3. An image forming apparatus, comprising:

feed means arranged on upstream and downstream sides of a web feed path;

tension control means arranged between these feed means in order to give a specified tension to said web;

walk control means for correcting the position of said web across the width of said feed path;

image forming means for forming an image on said web; and fixing means for drying and fixing the image that has been formed on said web by said image forming means;

said image forming apparatus being characterized in that it employs a low tension feed process comprising:

a step of keeping the tension of said web lower than that at the time of image formation until an initial loading position of said web across the width of said feed path reaches a target position of said walk control means, and a step of feeding said web while correcting walking movement thereof with said walk control means.

4. An image forming apparatus according to claim 3, wherein said low tension feed process is characterized in that said web feed speed is lower than the web feed speed used at the time of image formation.

5. An image forming apparatus according to claim 3, wherein said low tension feed process is characterized in that the difference in the distance between the initial web loading position and the target position of said walk control means is increased.

6. An image forming apparatus according to claim 3, characterized in that said walk control means comprises a walk sensor.

7. An image forming apparatus according to claim 3, characterized in that the time for terminating said low tension feed process is determined by processing a reading provided by a walk sensor.

8. An image forming apparatus according to any one of claim 3, 5 or 6, characterized in that the web feed speed of said low tension feed process is lower than that at the time of image formation.

* * * * *